US008469486B2

(12) United States Patent
Sutton et al.

(10) Patent No.: US 8,469,486 B2
(45) Date of Patent: Jun. 25, 2013

(54) IMAGE FORMING APPARATUS AND MEDIA SUPPORT DEVICE THEREOF

(75) Inventors: Donald Sutton, Camas, WA (US); Erick B Kinas, Camas, WA (US)

(73) Assignee: Hewlett-Packard Development Company, L. P., Houston, TX (US)

( * ) Notice: Subject to any disclaimer, the term of this patent is extended or adjusted under 35 U.S.C. 154(b) by 269 days.

(21) Appl. No.: 13/053,985

(22) Filed: Mar. 22, 2011

(65) Prior Publication Data

US 2012/0242743 A1 Sep. 27, 2012

(51) Int. Cl.
*B41J 2/165* (2006.01)

(52) U.S. Cl.
USPC ..... 347/31

(58) Field of Classification Search
USPC ..... 347/31
See application file for complete search history.

(56) References Cited

U.S. PATENT DOCUMENTS

| | | | | |
|---|---|---|---|---|
| 6,305,791 | B1 * | 10/2001 | Hotomi et al. | 347/70 |
| 6,986,574 | B2 * | 1/2006 | Nojima et al. | 347/104 |
| 7,645,037 | B2 | 1/2010 | Massey | |
| 2004/0027412 | A1 * | 2/2004 | Takahashi et al. | 347/34 |

* cited by examiner

*Primary Examiner* — Lamson Nguyen

(57) ABSTRACT

A media support device usable with an image forming apparatus is disclosed. The media support device includes a support surface having at least one media support area. The media support area is configured to receive and support media to receive ink ejected from an image forming apparatus thereto. The media support device also includes a plurality of cavities configured to store ink ejected from the image forming apparatus thereto. Each one of the cavities includes a cavity opening configured to receive the ink ejected from the image forming apparatus thereto.

16 Claims, 10 Drawing Sheets

IMAGE FORMING APPARATUS AND MEDIA SUPPORT DEVICE THEREOF

BACKGROUND

Image forming apparatuses provide ink to media to form images thereon. Image forming apparatuses include media support devices such as a platen to receive and support media on which images are to be formed. Some of the ink provided by the image forming apparatuses may at times be directed onto and adhere to the platen.

BRIEF DESCRIPTION OF THE DRAWINGS

Non-limiting examples are described in the following description, read with reference to the figures attached hereto and do not limit the scope of the claims. Dimensions of components and features illustrated in the figures are chosen primarily for convenience and clarity of presentation and are not necessarily to scale. Referring to the attached figures:

DETAILED DESCRIPTION

Figure 1:
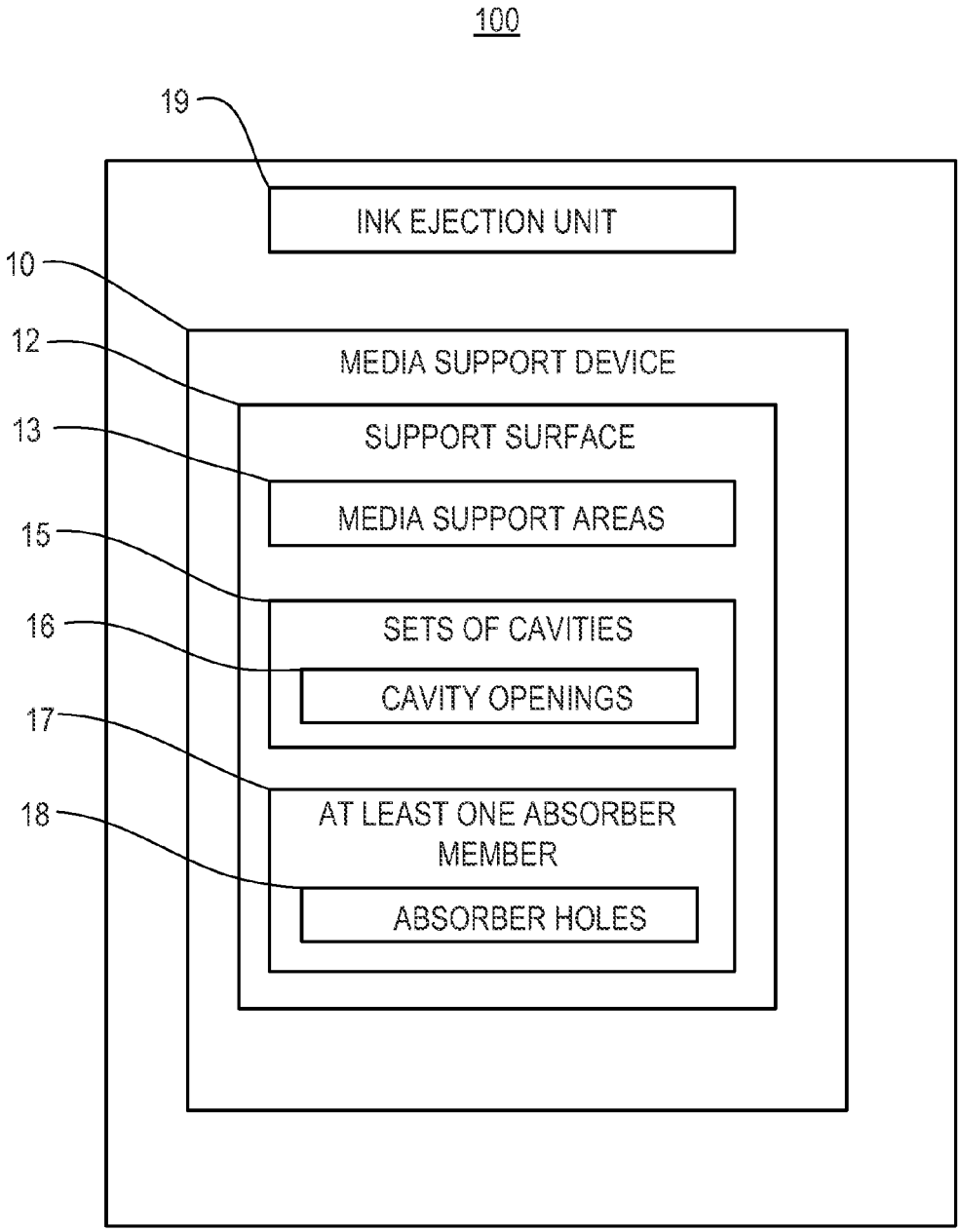
FIG. 1 is a block diagram of an image forming apparatus according to an example.

Image forming apparatuses provide ink to media to form images thereon such as in forming borderless prints and border prints. Image forming apparatuses include media support devices such as platens to receive and support media on which images are formed. Some of the ink provided by the image forming apparatuses, at times, may be directed onto the platen itself, for example, due to ink overspray that may potentially form an ink build-up as liquid and/or as sludge. The ink build-up may include ink solids and solvents. The ink build-up may also include compounds from the media itself and/or dust from the media or other sources mixing therewith. Borderless prints are prints with no unprinted margin at the edge of the media, whereas border prints are prints with unprinted margin at the edge of the media. Ink overspray will occur in borderless print jobs in which images are intentionally formed past the edges of the media. Thus, the ejection of ink past the edges of the media and onto the media support device is intended in such print jobs.

Ink overspray is an issue with both traditional dye-based inks and with newer pigment-based inks. Solid buildup or semi-solid buildup, or sludge, however, is a greater issue with pigment based inks than with dye-based inks. Specifically, pigment molecules of pigment color inks crash out of the ink solution when the ink contacts the media. Such pigment molecules generally lie on the surface of the media to improve color saturation. Additionally, media such as color-locking paper may include compounds that react with the pigment molecules to assist the crashing effect of the pigment color molecules. Such a reaction may also be conducive to the formation of sludge. The sludge may be undesirably transferred to media in the image forming apparatus. For example, the sludge may be transferred to the back of the media in the form of streaks which may be further transferred therefrom to other components of the image forming apparatus. Thus, the lifespan of such components and/or image forming apparatus may be reduced.

In examples, a media support device includes a support surface having at least one media support area and at least one border area adjacent to the at least one media support area, a plurality of cavities disposed on the border area of the support surface in which the cavities are configured to store ink ejected from the image forming apparatus thereto, and at least one absorber member configured to receive and absorb ink ejected from the image forming apparatus thereto. The absorber member is disposed on the support surface including a plurality of absorber holes to correspond with the respective cavity openings of the cavities. The cavity openings are located at areas of the media support device with the highest expected accumulation of ink such as overspray. Accordingly, sludge is effectively collected in the respective cavities to reduce the amount of sludge transferred to media and/or components of the image forming apparatus. Thus, unwanted streaking on the back of the media, and potential reduction in the lifespan of the components and image forming apparatus is delayed, increasing the useful life thereof.

FIG. 1 is a block diagram illustrating an image forming apparatus according to an example. In the present example, the image forming apparatus 100 is usable with media having various sizes (e.g., various-sized media). That is, the image forming apparatus 100 is capable of transporting, supporting and forming images on more than one size of media such as A4 media, four inch by six inch media, etc. Referring to FIG. 1, in the present example, an image forming apparatus 100 includes an ink ejection unit 19 configured to eject ink to form images on media of various sizes. For example, one print job may use A4 media and another print job may use four inch by six inch media. In examples, the image forming apparatus 100 may be a digital copier, printer such as an inkjet printer, bookmaking machine, facsimile machine, multi-function machine, or the like. In an example, the ink ejection unit 19 may include an inkjet print head.

Referring to FIG. 1, in the present example, the image forming apparatus 100 also includes a media support device 10 configured to receive the respective media to receive ink ejected from the ink ejection unit 19. The media support device 10 includes a support surface 12, a plurality of sets of cavities 15*a* and 15*b* (collectively 15), and at least one absorber member 17. In the present example, the support surface 12 is a respective surface of the media support device 10 disposed to face the respective media when the media is placed in a position on which to be printed. For example, the support surface 12 may be an upper surface of the media support device 10. The support surface 12 of the media support device 10 includes a plurality of media support areas 13*a* and 13*b* (collectively 13) configured to support the various-sized media, respectively. For example, a first media support area 13*a* may correspond to four inch by six inch media and a second media support area 13*b* may correspond to A4 media, or the like (FIG. 2).

Each one of the respective sets of cavities 15 are configured to store the received ink such as overspray and corresponds to the respective media support areas 13*a* and 13*b*. That is, each one of the respective sets of cavities 15 correspond to a respective edge of the media for a particular size or similar sizes of media when supported on the respective media support areas 13*a* and 13*b*. Each cavity 15$a_1$, 15$a_2$, 15$b_1$ and 15$b_2$ (FIG. 3A) includes a cavity opening 16 configured to receive ink such as overspray ejected from the ink ejection unit 19 not received by the respective media. For example, the respective cavity opening 16 may receive ink such as overspray directed thereto. The ink overspray will accumulate as liquid and/or sludge in the respective cavity 15.

Figure 2:
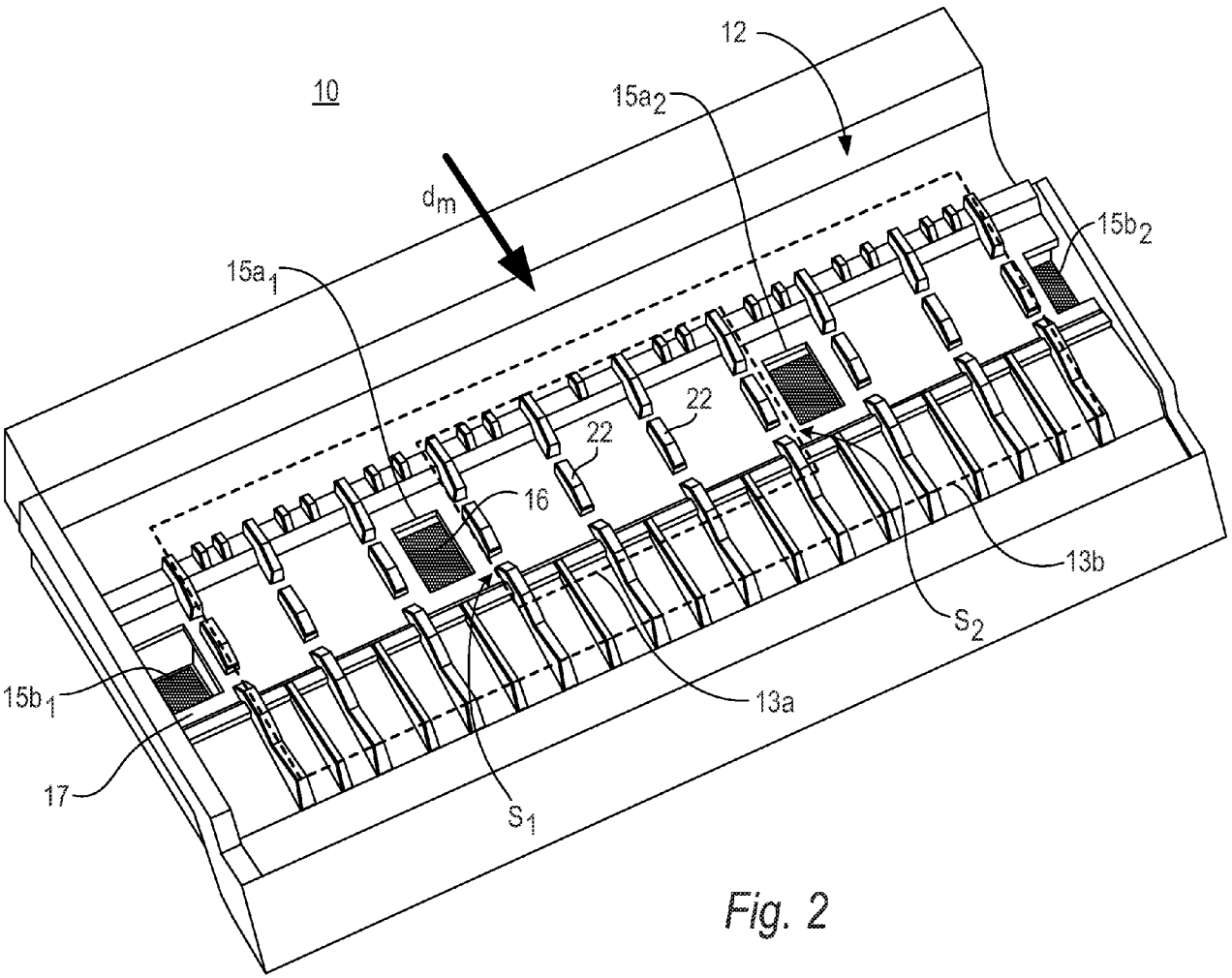
FIG. 2 is an isometric view illustrating a media support device of the image forming apparatus of FIG. 1 according to an example.
Figure 3A:
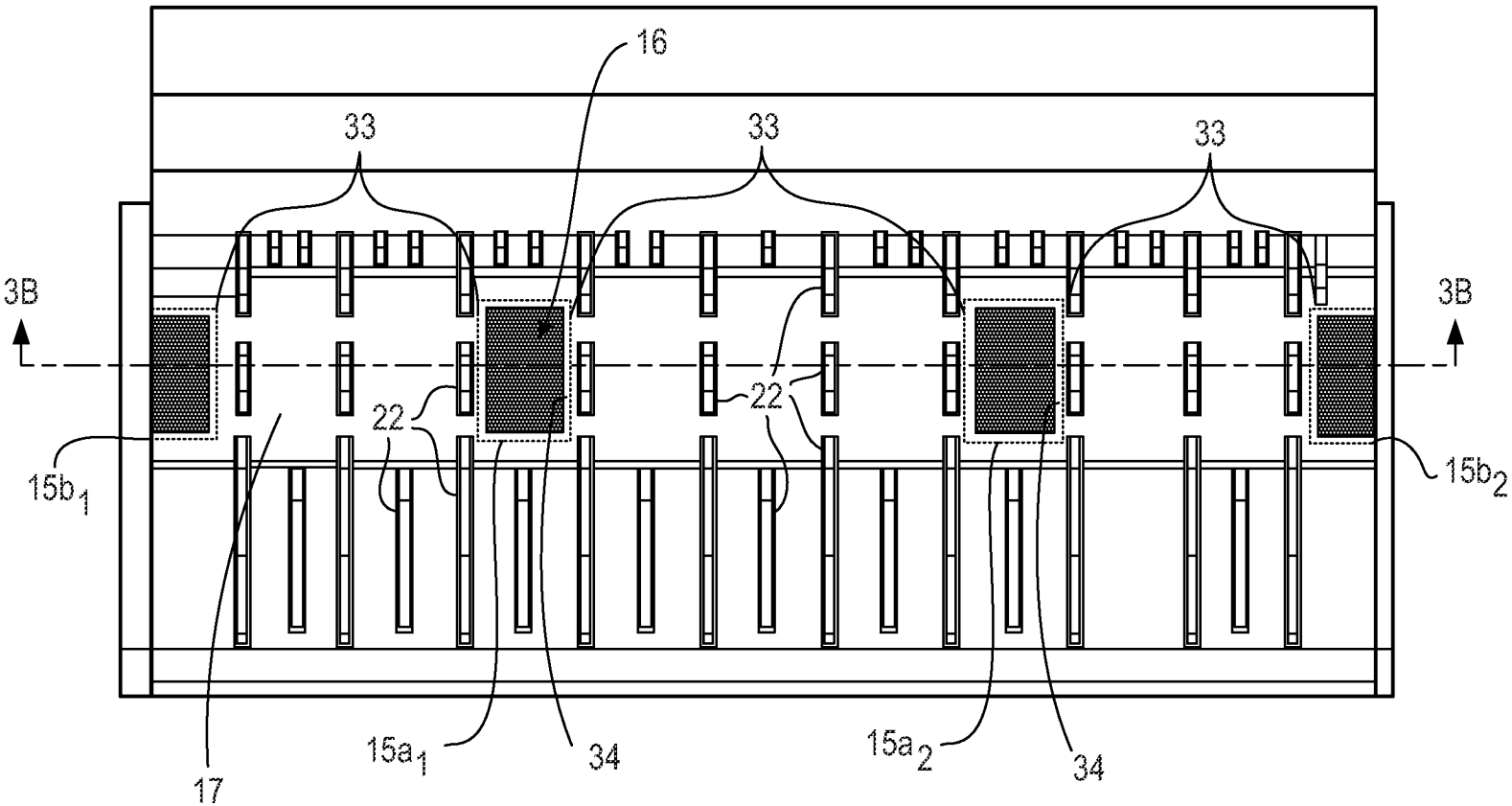
FIG. 3A is a top view illustrating the media support device of FIG. 2 according to an example.
Figure 3B:
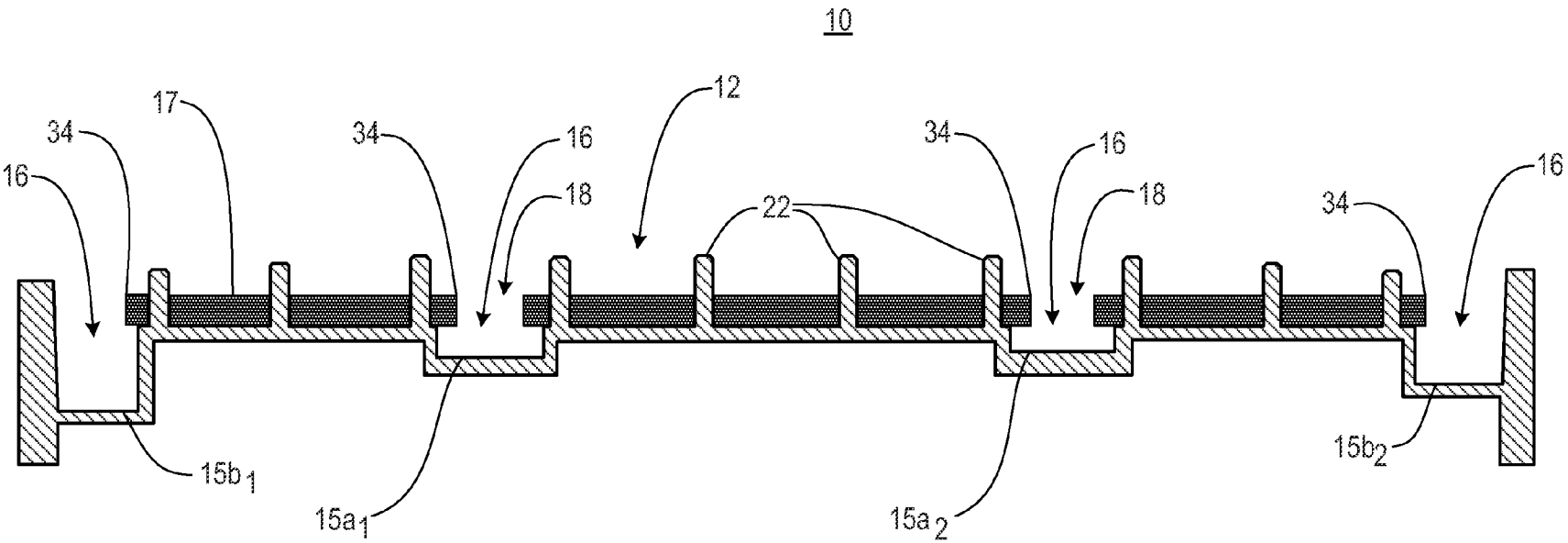
FIG. 3B is a cross-sectional view of the media support device of FIG. 3A along line 3B-3B according to an example.

FIG. 2 is an isometric view illustrating a media support device of the image forming apparatus of FIG. 1 according to an example. FIG. 3A is a top view illustrating the media support device of FIG. 2 according to an example. FIG. 3B is a cross-sectional view of the media support device of FIG. 3A along line 3B-3B according to an example. Referring to FIGS. 2-3B, each one of the respective sets of cavities 15*a* and 15*b* are configured to store the received ink such as overspray and corresponds to a particular media size or group of sizes that are supported on the respective media support areas 13*a* and 13*b*. For example, a first set of cavities 15*a* corresponds to a first media size group that is supported by a first media support area 13*a* and a second set of cavities 15*b* corresponds to a second media size group that is supported by a second media support area 13*b*. The respective set of cavities 15*a* and 15*b* are disposed on the support surface 12 of the media support device 10 outside of corresponding media support areas 13*a* and 13*b*. In the present example, the absorber member 17 is adjacent to the respective cavities 15$a_1$, 15$a_2$, 15$b_1$ and 15$b_2$. Thus, the first set of cavities 15*a* are disposed outside the first media support area 13*a* and the second set of cavities 15*b* are disposed outside of the second media support area 13*b*. The cavities 15$a_1$, 15$a_2$, 15$b_1$ and 15$b_2$ have a sufficient depth to retain sludge therein in a manner to reduce the ability of the sludge to contact the media.

Referring to FIGS. 2-3*b*, in an example, the cavities 15$a_1$ and 15$a_2$ of a respective set of cavities 15*a* are disposed across from at least two sides $s_1$ and $s_2$ of a corresponding media support area 13*a* such that the two sides $s_1$ and $s_2$ are at least one of approximately parallel to and elongated in a media transport direction $d_m$. In an example, the two sides $s_1$ and $s_2$ may be at an angle in a range of 160 to 200 degrees with respect to the media transport direction $d_m$. The media transport direction $d_m$ is a direction in which the media is fed to the respective media support area 13*a*. For example, the cavities 15$a_1$ and 15$a_2$ corresponding to a respective media support area 13*a* may be placed proximate to and across from left and right sides $s_1$ and $s_2$ of the respective media support area 13*a* which align with the left and right edges of the respective media to be printed on. Generally, an area proximate to and across from left and right sides $s_1$ and $s_2$ of the respective media support area 13*a* which align with the left and right edges of the respective size media receives a greater amount of ink build-up from the respective printing passes as compared to other areas of the support surface 12.

Referring to FIGS. 2-3B, in an example, the absorber member 17 is disposed adjacent to the respective cavities 15$a_1$, 15$a_2$, 15$b_1$ and 15$b_2$ and includes a plurality of absorber holes 18 to correspond with the respective cavity openings 16 of the cavities 15$a_1$, 15$a_2$, 15$b_1$ and 15$b_2$. The absorber holes 18 are configured to allow ink ejected thereto to pass through to the respective cavities 15$a_1$ and 15$a_2$. In examples, the support surface 12 of the media support device 10 may further include a plurality of ribs 22 configured to support the respective media in a non-contact state with the absorber member 17. The non-contact state is a state in which the media is supported by the ribs 22 in a manner in which the media does not contact the absorber member 17. For example, the ribs 22 may be elevated from the absorber member 17 and contact the media to position the media above the absorber member 17 and out-of-contact with the absorber member 17.

Referring to FIGS. 2-3B, the absorber member 17 may include a plurality of surrounding portions 33 and overlap portions 34. Each one of the surrounding portions 33 may correspond to and surround at least a portion of a respective cavity opening 16 of a respective one of the cavities 15$a_1$, 15$a_2$, 15$b_1$ and 15$b_2$. Each one of the overlap portions 34 may correspond to and overlap a portion of the respective cavity opening 16 of the respective one of the cavities 15$a_1$, 15$a_2$, 15$b_1$ and 15$b_2$. The overlap portions 34, for example, may mitigate the splashing or spilling of ink such as liquid and/or sludge from the respective cavities 15$a_1$, 15$a_2$, 15$b_1$ and 15$b_2$ due to movement of the image forming apparatus 100. A respective overlap portion 34 and a corresponding surrounding portion 33 of the absorber member 17 may be adjacent to each other. The overlap portion 34 and corresponding surrounding portion 33 may be indistinguishable from each other and only differ in terms of location when applied to the media support device 10.

Figure 4A:
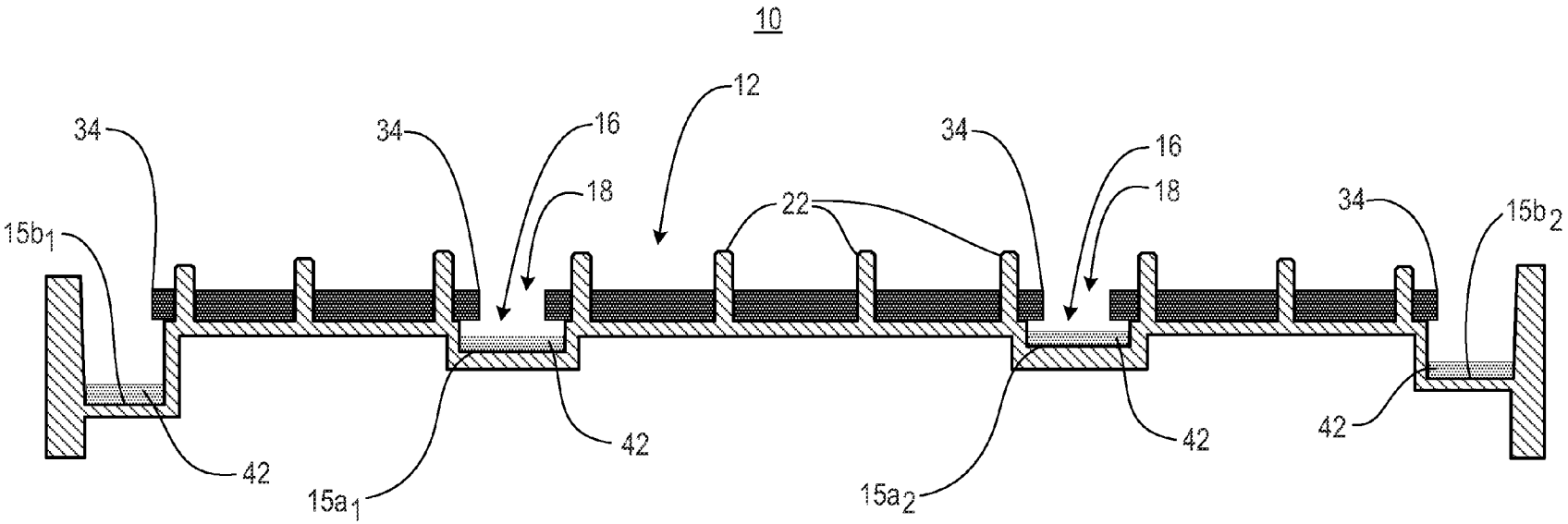
FIG. 4A is a cross-sectional view of the media support device of FIG. 2 including internal absorber members according to another example.

FIG. 4A is a cross-sectional view of the media support device of FIG. 2 including internal absorber members according to another example. Referring to FIG. 4A, in an example, each one of the cavities 15$a_1$, 15$a_2$, 15$b_1$ and 15$b_2$ may include an internal absorber member 42 configured to store the received ink received by the respective cavity opening 16 inside of the respective cavity 15$a_1$, 15$a_2$, 15$b_1$ and 15$b_2$. The internal absorber member 42 provides increased absorption of ink in the form of liquid to reduce risk of a spill. The internal absorber member 42 may include capillary absorbing material such as polyester needle felt, and/or other types of absorbing materials.

Figure 4B:
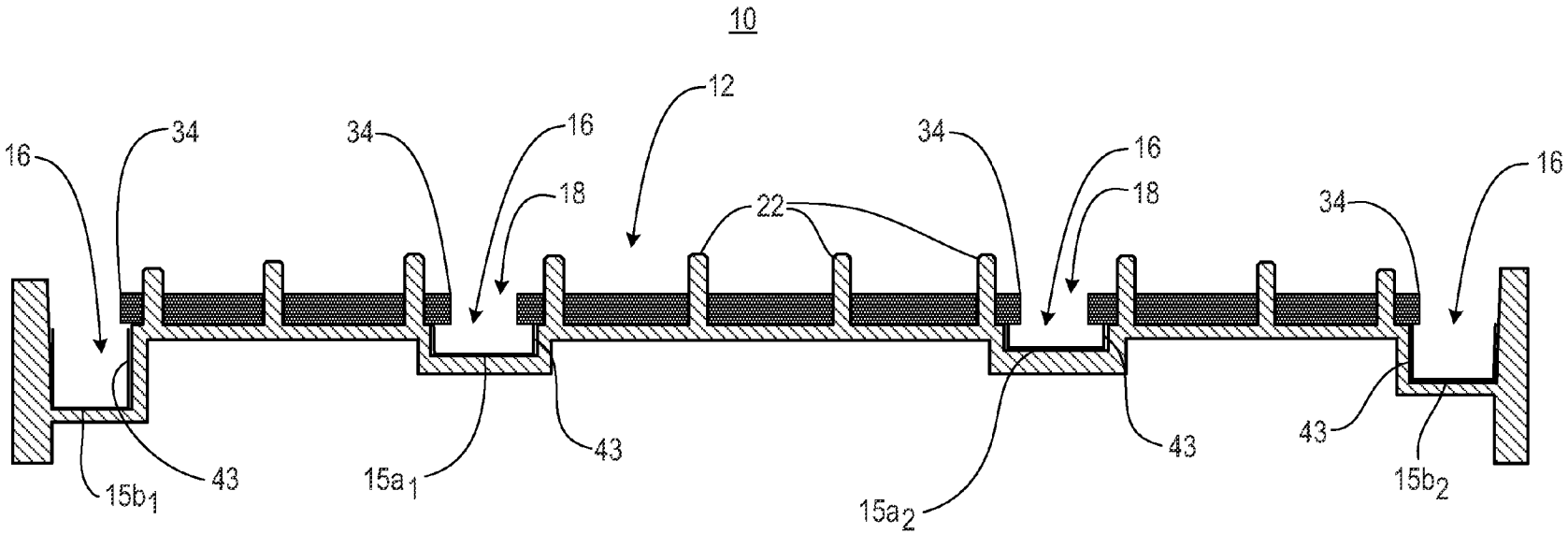
FIG. 4B is a cross-sectional view of the media support device of FIG. 2 including removable cavity liners according to another example.

FIG. 4B is a cross-sectional view of the media support device of FIG. 2 including removable cavity liners according to another example. In an example, each one of the cavities 15$a_1$, 15$a_2$, 15$b_1$ and 15$b_2$ may include a removable cavity liner 43 configured to store the received ink received by the respective cavity openings 16 and ejected from the ink ejection unit 19. The removable cavity liners 43 are configured to store the ink ejected from the image forming apparatus 100 and received by the respective cavity opening 16. The removable cavity liners 43 may be removably attached to the media support device 10. For example, the cavity liners 43 may be removed from the media support device 10 to empty out the unwanted ink such as liquid and/or sludge stored therein. In an example, in the removal of the cavity liners 43, the respective overlap portions 34 may be flexible to allow the cavity liners 43 to pass through the cavity openings 16. Alternatively, the absorber openings 18 may be enlarged to allow easy removal of cavity liners 43, for example, through the elimination of the overlap portion 34. Subsequently, the emptied-out removable cavity liners 43 may be reinstalled in the media support device 10. Alternatively, the removable cavity liners 43 may be removed from the media support device 10 and discarded. Subsequently, new removable cavity liners 43 may be installed in the media support device 10 to replace the discarded ones.

Figure 5A:
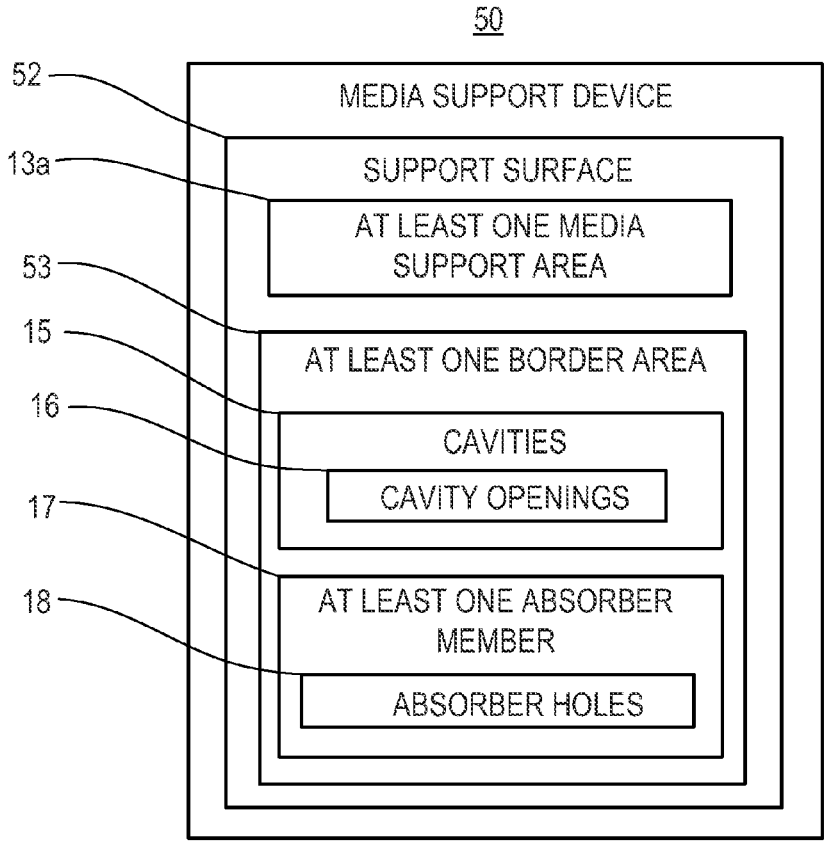
FIGS. 5A and 5B are block diagrams of media support devices usable with an image forming apparatus according to examples.

FIG. 5A is a block diagram of a media support device usable with an image forming apparatus according to an example. Referring to FIG. 5A, a media support device 50 includes a support surface 52 including at least one media support area 13*a* and at least one border area 53, a plurality of cavities 15$a_1$ and 15$a_2$ (collectively 15) including cavity openings 16, respectively. The media support device 50 may include at least one absorber member 17 including a plurality of absorber holes 18. In the present example, the support surface 52 is a respective surface of the media support device 50 disposed to face the back surface of the respective media when the media is placed in a position on which to be printed. The media support area 13*a* is configured to receive and support media to receive ink ejected from an image forming apparatus thereto. The cavities 15$a_1$ and 15$a_2$ are configured to store ink ejected from the image forming apparatus thereto. The cavity opening 16 is configured to receive the ink ejected from the image forming apparatus thereto. The absorber member 17 is configured to receive and absorb ink ejected from the image forming apparatus thereto. The absorber holes 18 of the absorber member 17 correspond to the respective cavity openings 16 of the cavities 15$a_1$ and 15$a_2$. The absorber holes 18 are configured to allow ink ejected thereto to pass through to the respective cavities 15$a_1$ and 15$a_2$. The absorber member 17 may include polyester felt materials, and/or other types of absorbing materials.

Figure 5B:
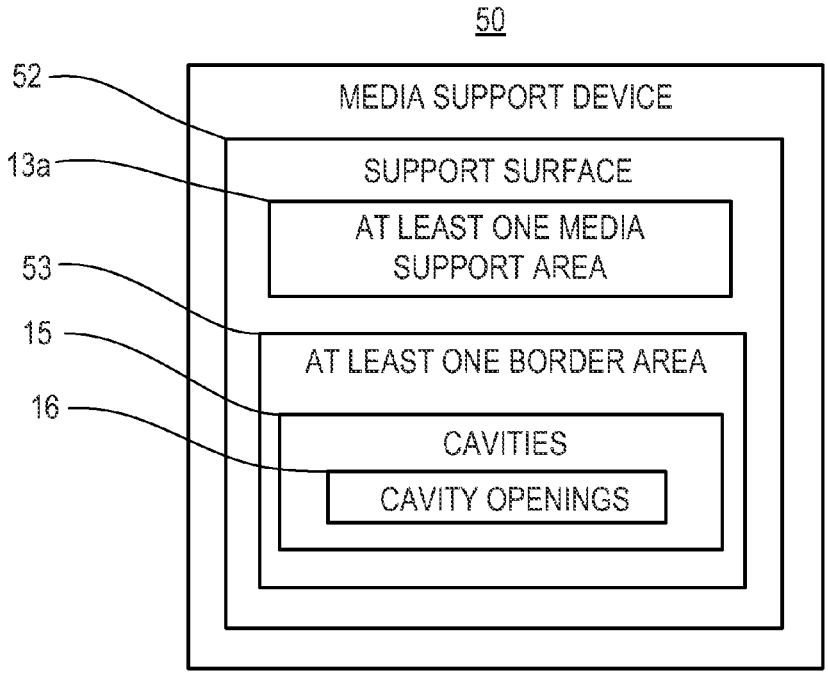
Figure 6:
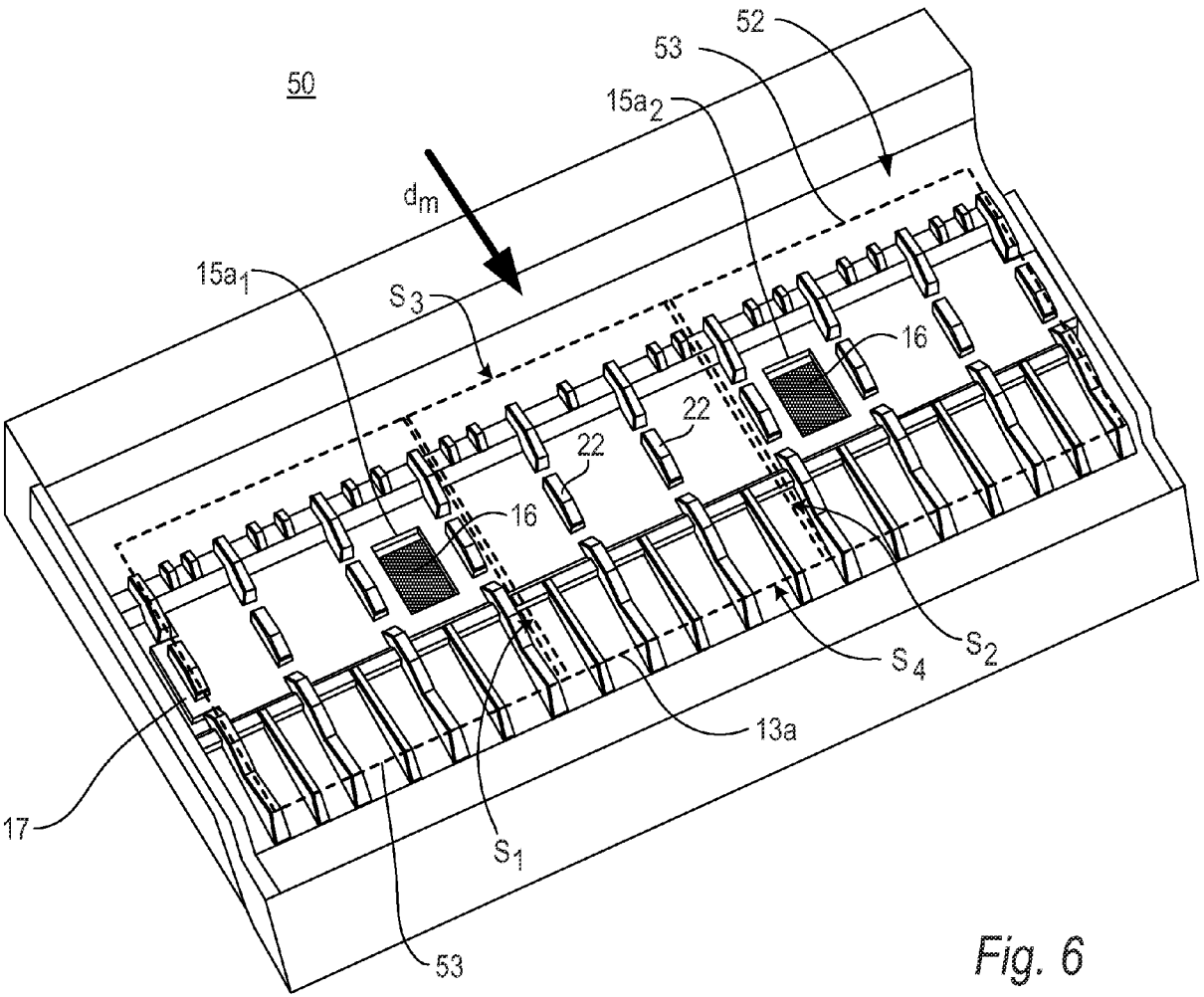
FIG. 6 is an isometric view illustrating the media support device of FIGS. 5A and 5B according to examples.

FIG. 5B is a block diagram of a media support device usable with an image forming apparatus according to an example. Referring to FIG. 5B, a media support device 50 includes a support surface 52 including at least one media support area 13*a* and at least one border area 53, and a plurality of cavities 15$a_1$ and 15$a_2$ (collectively 15) including cavity openings 16, respectively. In the present example, the support surface 52 is a respective surface of the media support device 50 disposed to face the back surface of the respective media when the media is placed in a position on which to be printed. The media support area 13*a* is configured to receive and support media to receive ink ejected from an image forming apparatus thereto. The cavities 15$a_1$ and 15$a_2$ are configured to store ink ejected from the image forming apparatus thereto. The cavity opening 16 is configured to receive the ink ejected from the image forming apparatus thereto. The cavities 15$a_1$ and 15$a_2$ are disposed across from at least two sides $s_1$ and $s_2$ of the respective at least one media support area at least approximately parallel to and elongated in a media transport direction $d_m$, for example, as illustrated in FIG. 6. In an example, the media support device 50 illustrated in FIG. 5B may also include ribs 22 (FIG. 6) to support the respective media out of contact with portions of the support surface 52 that may hold ink such as overspray.

Figure 7A:
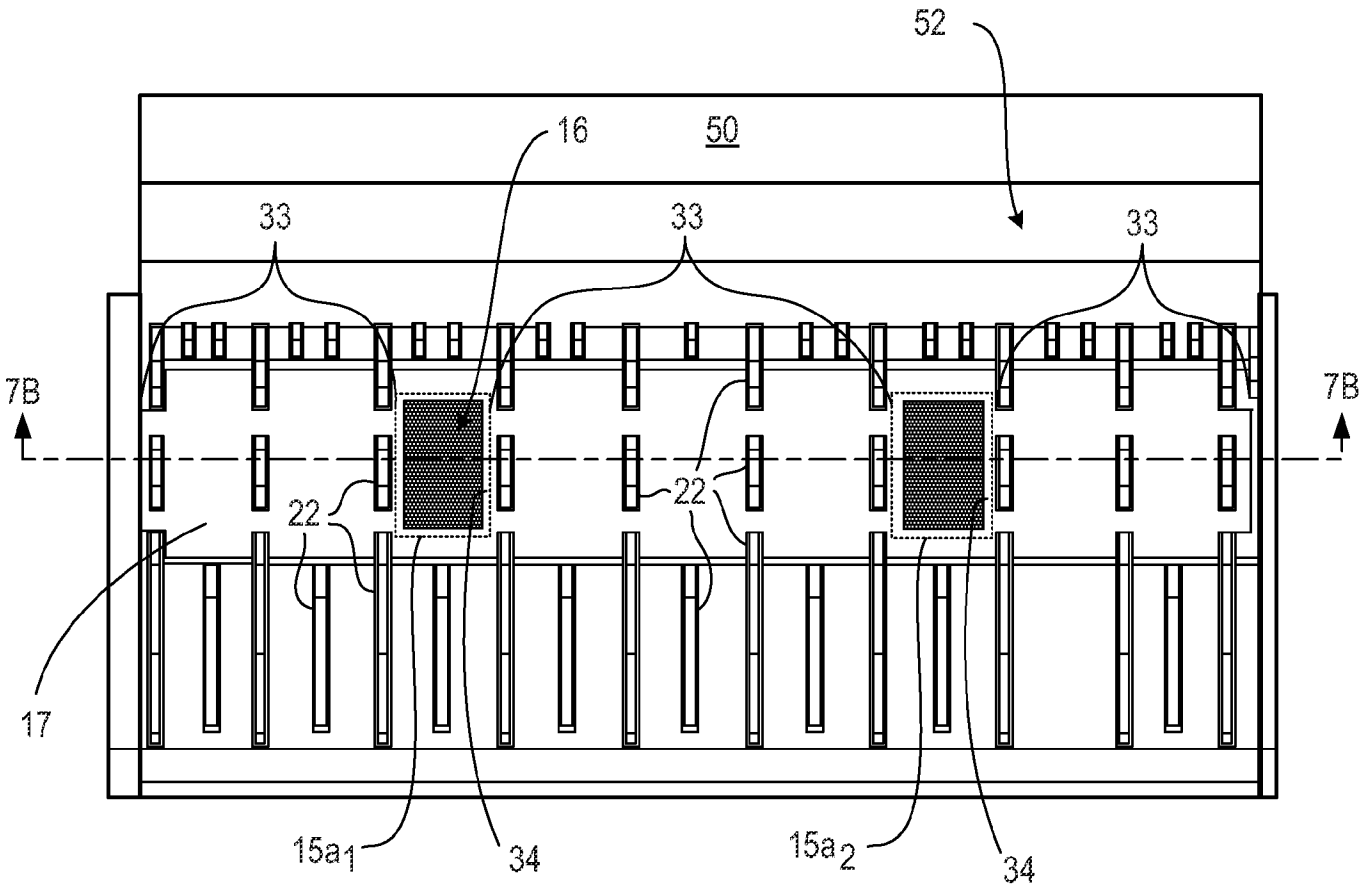
FIG. 7A is a top view illustrating the media support device of FIG. 6 according to an example.
Figure 7B:
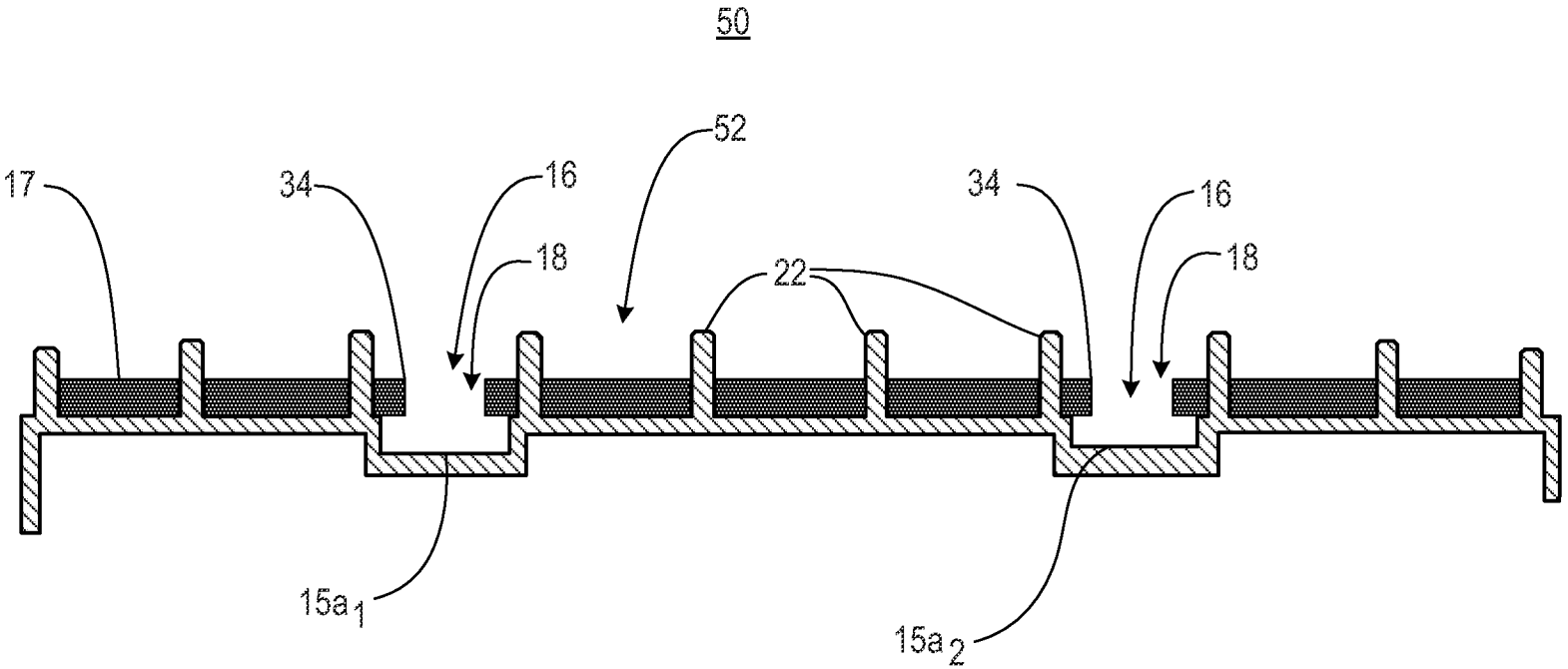
FIG. 7B is a cross-sectional view illustrating the media support device of FIG. 7A along line 7B-7B according to an example.

FIG. 6 is an isometric view illustrating the media support device of FIGS. 5A and 5B according to examples. FIG. 7A is a top view illustrating the media support device of FIG. 6 according to an example. FIG. 7B is a cross-sectional view illustrating the media support device of FIG. 7A along line 7B-7B according to an example. Referring to FIGS. 6-7B, in an example, the media support device 50 includes one media support area 13*a*. The media support area 13*a* may correspond to media of a predetermined size such as four inch by six inch media, or the like. The media support device 50 may also include corresponding border areas 53 adjacent and corresponding to the respective media support area 13*a*. In other examples, the media support device 50 may include more than one media support area 13*a* and 13*b* as previously disclosed with respect to the media support device 10 illustrated in FIGS. 2-3B. For example, each one of the respective media support areas 13*a* and 13*b* may correspond to media having a unique and predetermined size, or a range of sizes.

Referring to FIGS. 6-7B, in the present example, the cavities 15$a_1$ and 15$a_2$ are disposed on the border area 53 of the support surface 52. Each one of the cavities 15$a_1$ and 15$a_2$ includes a cavity opening 16 to receive the ink ejected from an image forming apparatus thereto. In examples, the cavities 15$a_1$ and 15$a_2$ of a respective set of cavities 15*a* are disposed across from at least two sides $s_1$, $s_2$, $s_3$ and $s_4$ of a corresponding media support area 13*a*. In the present example, the at least two sides $s_1$ and $s_2$ are at least one of approximately parallel to and elongated in a media transport direction $d_m$. In the present example, the cavities 15$a_1$ and 15$a_2$ corresponding to a respective media support area 13*a* are placed proximate to and across from left and right sides $s_1$ and $s_2$ of the respective media support area 13*a* which align with the left and right edges of the respective media or range of media to be printed on as previously disclosed with respect to the support surface 12 of the media support device 10 illustrated in FIGS. 2-3B.

Referring to FIGS. 7A and 7B, in the present example, the media support device 50 includes one absorber member 17 disposed on the support surface 52. In an example, the absorber member is disposed adjacent to the cavities 15$a_1$ and 15$a_2$. In other examples, the absorber member 17 includes more than one absorber member (not illustrated). In examples, the support surface 52 of the media support device 50 may also include plurality of ribs 22. The ribs 22 of the support surface 52 are configured to support the respective media in a non-contact state with the absorber member 17 as previously disclosed with respect to the support surface 12 of the media support device 10 illustrated in FIG. 2.

In examples, the absorber member 17 may also include a plurality of surrounding portions 33 and overlap portions 34. In an example, each one of the surrounding portions 33 of the absorber member 17 may correspond to and at least partially surround a respective cavity opening 16 of a respective one of the cavities 15$a_1$ and 15$a_2$. Also, each one of the overlap portions 34 may correspond to and overlap a portion of the respective cavity opening 16 of the respective one of the cavities 15$a_1$ and 15$a_2$. A respective overlap portion 34 and a corresponding surrounding portion 33 of the absorber member 17 may be adjacent to each other. The cavities 15$a_1$ and 15$a_2$ of the media device 50 may also include respective internal absorbing members 42 and/or cavity liners 43 as previously disclosed with reference to the media support device 10 illustrated in FIGS. 4A and 4B, respectively.

The present disclosure has been described using non-limiting detailed descriptions of examples thereof that are not intended to limit the scope of the general inventive concept. It should be understood that features and/or operations described with respect to one example may be used with other examples and that not all examples have all of the features and/or operations illustrated in a particular figure or described with respect to one of the examples. Variations of examples described will occur to persons of the art. Furthermore, the terms "comprise," "include," "have" and their conjugates, shall mean, when used in the disclosure and/or claims, "including but not necessarily limited to."

It is noted that some of the above described examples may include structure, acts or details of structures and acts that may not be essential to the general inventive concept and which are described for illustrative purposes. Structure and acts described herein are replaceable by equivalents, which perform the same function, even if the structure or acts are different, as known in the art. Therefore, the scope of the general inventive concept is limited only by the elements and limitations as used in the claims.

What is claimed is:

1. A media support device usable with an image forming apparatus, the media support device comprising:

a support surface having at least one media support area and at least one border area adjacent to the at least one media support area, the at least one media support area is configured to receive and support media to receive ink ejected from an image forming apparatus thereto;

a plurality of cavities disposed on the border area of the support surface and configured to store ink ejected from the image forming apparatus thereto, each one of the plurality of cavities having a cavity opening configured to receive the ink ejected from the image forming apparatus thereto; and at least one absorber member configured to receive and absorb ink ejected from the image forming apparatus thereto, the at least one absorber member is disposed on the support surface and includes a plurality of absorber holes to correspond with the respective cavity openings of the cavities and to allow ink ejected thereto to pass through to the respective cavities.

2. The media support device according to claim 1, wherein the support surface further comprises:

a plurality of ribs configured to support the respective media in a non-contact state with the at least one absorber member.

3. The media support device according to claim 1, wherein the at least one absorber member comprises:

a plurality of surrounding portions, each one of the surrounding portions corresponds to and at least partially surrounds a respective cavity opening of a respective one of the plurality of cavities.

4. The media support device according to claim 3, wherein the at least one absorber member further comprises:

a plurality of overlap portions, each one of the overlap portions corresponds to and overlaps a portion of the respective cavity opening of the respective one of the plurality of cavities.

5. The media support device according to claim 4, wherein a respective overlap portion and a corresponding surrounding portion of the at least one absorber member are adjacent to each other.

6. The media support device according to claim 1, wherein the cavities are disposed across from at least two sides of the respective at least one media support area.

7. The media support device according to claim 6, wherein the at least two sides are at least one of approximately parallel to and elongated in a media transport direction.

8. The media support device according to claim 1, wherein each one of the plurality of cavities further comprises at least one of:

an internal absorber member configured to store the received ink received by the respective cavity opening inside of the respective cavity; and a removable cavity liner configured to store the received ink received by the respective cavity opening and ejected from the image forming apparatus thereto, wherein the removable cavity liner is removably attached to the media support device.

9. An image forming apparatus usable with media having various sizes, the image forming apparatus comprising:

an ink ejection unit configured to eject ink to form images on media having various sizes; and a media support device configured to receive the respective media to receive ink ejected from the ink ejection unit, the media support device comprising:

a support surface having a plurality of media support areas configured to support the various-sized media, respectively;

a plurality of sets of cavities such that each cavity includes a cavity opening configured to receive ink ejected from the ink ejection unit not received by the respective media, each one of the respective sets of cavities is configured to store the received ink and corresponds to the respective media support areas such that the respective sets of cavities are disposed on the support surface of the media support device outside of corresponding media support areas; and at least one absorber member corresponding to the plurality of cavities configured to receive and absorb ink ejected from the ink ejection unit thereto, the at least one absorber member is disposed on the support surface and includes a plurality of absorber holes to correspond with the respective cavity openings of the cavities and to allow ink ejected thereto to pass through to the respective cavities.

10. The image forming apparatus according to claim 9, wherein the support surface further comprises:

a plurality of ribs configured to support the respective media in a non-contact state with the at least one absorber member.

11. The image forming apparatus according to claim 9, wherein the at least one absorber member comprises:

a plurality of surrounding portions, each one of the surrounding portions corresponds to and at least partially surrounds a respective cavity opening of a respective one of the plurality of cavities.

12. The image forming apparatus according to claim 11, wherein the at least one absorber member further comprises:

a plurality of overlap portions, each one of the overlap portions corresponds to and overlaps a portion of the respective cavity opening of the respective one of the plurality of cavities.

13. The image forming apparatus according to claim 12, wherein a respective overlap portion and a corresponding surrounding portion of the at least one absorber member are adjacent to each other.

14. The image forming apparatus according to claim 9, wherein the cavities of a respective set of cavities are disposed across from at least two sides of a corresponding media support area such that the at least two sides are at least one of approximately parallel to and aligned with a media transport direction.

15. A media support device usable with an image forming apparatus, the media support device comprising:

a support surface having at least one media support area and at least one border area adjacent to the at least one media support area, the at least one media support area is configured to receive and support media to receive ink ejected from an image forming apparatus thereto;

a plurality of cavities disposed on the border area of the support surface and configured to store ink ejected from the image forming apparatus thereto, each one of the plurality of cavities having a cavity opening configured to receive the ink ejected from the image forming apparatus thereto and at least one of an internal absorber member and a removable cavity liner;

the internal absorber member configured to store the received ink received by the respective cavity opening inside of the respective cavity; and the removable cavity liner removably attached to the media support device and configured to store the received ink received by the respective cavity opening and ejected from the image forming apparatus thereto; and at least one absorber member configured to receive and absorb ink ejected from the image forming apparatus thereto, the at least one absorber member is disposed on the support surface and includes a plurality of absorber holes to correspond with the respective cavity openings of the cavities.

16. An image forming apparatus usable with media having various sizes, the image forming apparatus comprising:

an ink ejection unit configured to eject ink to form images on media having various sizes; and a media support device configured to receive the respective media to receive ink ejected from the ink ejection unit, the media support device comprising:

a support surface having a plurality of media support areas configured to support the various-sized media, respectively;

a plurality of sets of cavities such that each cavity includes a cavity opening configured to receive ink ejected from the ink ejection unit not received by the respective media, each one of the respective sets of cavities is configured to store the received ink and corresponds to the respective media support areas such that the respective sets of cavities are disposed on the support surface of the media support device outside of corresponding media support areas;

each one of the plurality of cavities further includes at least one of an internal absorber member configured to store the received ink received by the respective cavity opening inside of the respective cavity, and a removable cavity liner removably attached to the media support device and configured to store the received ink received by the respective cavity openings and ejected from the ink ejection unit; and at least one absorber member corresponding to the plurality of cavities configured to receive and absorb ink ejected from the ink ejection unit thereto, the at least one absorber member is disposed on the support surface and includes a plurality of absorber holes to correspond with the respective cavity openings of the cavities.

* * * * *